US011192273B2

(12) United States Patent
Ishizawa

(10) Patent No.: US 11,192,273 B2
(45) Date of Patent: Dec. 7, 2021

(54) DEBARKING MACHINE

(71) Applicant: FUJI KOGYO CO., LTD., Fujieda (JP)

(72) Inventor: Seiya Ishizawa, Fujieda (JP)

(73) Assignee: FUJI KOGYO CO., LTD., Fujieda (JP)

( * ) Notice: Subject to any disclaimer, the term of this patent is extended or adjusted under 35 U.S.C. 154(b) by 93 days.

(21) Appl. No.: 16/739,790

(22) Filed: Jan. 10, 2020

(65) Prior Publication Data

US 2020/0298439 A1 Sep. 24, 2020

(30) Foreign Application Priority Data

Mar. 19, 2019 (JP) ..... JP2019-050618

(51) Int. Cl.
*B27L 1/10* (2006.01)
*B27L 1/05* (2006.01)

(52) U.S. Cl.
CPC .. *B27L 1/10* (2013.01); *B27L 1/05* (2013.01)

(58) Field of Classification Search
CPC ..... B27L 1/04; B27L 1/05; B27L 1/10
See application file for complete search history.

(56) References Cited

U.S. PATENT DOCUMENTS 4,685,498 A 8/1987 Nakajima et al.
5,630,453 A 5/1997 Ishizawa
5,647,418 A 7/1997 Ishizawa
5,699,843 A * 12/1997 Gagne ..... B27L 1/02 144/208.9
2017/0087740 A1* 3/2017 Perreault ..... B27L 1/02

FOREIGN PATENT DOCUMENTS

JP S63-207604 A 8/1988
JP H02-269002 A 11/1990

OTHER PUBLICATIONS

Kadant, Fuji King Debarker, 2014 (Year: 2014).*
Logging & Sawmilling Journal, Tech Update—Debarkers, 2017, https://forestnet.com/LSJissues/2017_Aug_September/tech-update.php (Year: 2017).*
Japan Patent Office, "Office Action for Japanese Patent Application No. 2019-050618," dated Mar. 3, 2021.

* cited by examiner

*Primary Examiner* — Matthew Katcoff
(74) *Attorney, Agent, or Firm* — Manabu Kanesaka

(57) ABSTRACT

A debarking machine is provided with a plurality of rotors disposed in parallel, and a gap between the rotors is blocked by a comb-tooth shape partition plate. The debarking machine is further provided with a log accommodating body, rotors rotatively mounted inside the log accommodating body and provided with debarking plates, a comb-tooth shape partition plate base disposed at a space between the rotors, a comb-tooth shape partition plate detachably mounted on the comb-tooth shape partition plate base, and a fixer for fastening the comb-tooth shape partition plate to the comb-tooth shape partition plate base. The comb-tooth shape partition plate is composed of partition plate elements divided along the axial directions the rotors, and each partition plate element is detachable separately. Thus the comb-tooth shape partition plates can be rebuilt and replaced easily.

7 Claims, 8 Drawing Sheets

DEBARKING MACHINE

RELATED APPLICATIONS

The present application is based on, and claims priority from, Japanese Application No. JP2019-050618 filed Mar. 19, 2019, the disclosure of which is hereby incorporated by reference herein in its entirety.

TECHNICAL FIELD

The present invention relates to a debarking machine, which for example peels bark from the surface of logs. More specifically, the present invention relates to a debarking machine, provided with a plurality of rotors disposed in parallel, and with a comb-tooth shape partition plate for blocking the mutual space between the rotors or between the rotor and the debarker inside walls, in which rebuilding and replacement works of the comb-tooth shape partition plate are facilitated.

BACKGROUND ART

A conventional debarking machine has, for example, a structure as illustrated in FIG. 9 and FIG. 10. First, a concrete foundation 201 is provided, and a log accommodating body 203 is mounted on the concrete foundation 201. The log accommodating body 203 comprises a pair of side walls 205, 207, etc. Rotors 209, 211 are rotatively provided in parallel, respectively, inside the log accommodating body 203. The rotor 211 is disposed obliquely downward of the rotor 209.

The rotor 209 is in a cylindrical shape, and shafts 213, 215 are protrusively provided, respectively, at each end of the rotor 209. The rotor 209 is pivotally supported by bearings 217, 219, via the shafts 213, 215, respectively. A plurality of debarking plates 221 is mounted on the outer peripheral surface of the rotor 209, and at the top surface of each of the debarking plates 221, a plurality of edges 223 is provided. Each of the edges 223 has a function of peeling bark from the surface of logs.

The rotor 211 has substantially the same structure as that of the rotor 209, and shafts 225, 227 are protrusively provided, respectively, at each end of the rotor 211. The rotor 211 is pivotally supported by bearings 229, 231, via the shafts 225, 227, respectively. A plurality of debarking plates 233 is mounted on the outer peripheral surface of the rotor 211, and at the top surface of each of the debarking plates 233, a plurality of edges 235 is provided. Each of the edges 235 has a function of peeling bark from the surface of logs.

The rotors 209, 211 are rotated by an unillustrated driving motor and rotation transmission mechanism, in the directions shown by arrows a and b of FIG. 10, respectively.

A comb-tooth shape partition plate 237 is disposed between the side wall 205 and the rotor 209. A comb-tooth shape partition plate 239 is disposed between the rotor 209 and the rotor 211. Moreover, a comb-tooth shape partition plate 241 is disposed between the rotor 211 and the side wall 207.

The comb-tooth shape partition plate 237 is provided with a plurality of slits 243 at predetermined spacings, on the side of the rotor 209, and each of the debarking plates 221 of the rotor 209 passes through each of the slits 243. Moreover, with regard to the comb-tooth shape partition plate 239, a plurality of slits 245 is provided at predetermined spacings on the side of the rotor 209, and a plurality of slits 247 is provided at predetermined spacings on the side of the rotor 211. Each of the debarking plates 221 of the rotor 209 passes through each of the slits 245, and each of the debarking plates 233 of the rotor 211 passes through each of the slits 247, respectively. Moreover, the comb-tooth shape partition plate 241 is provided with a plurality of slits 249 on the side of the rotor 211, and each of the debarking plates 233 of the rotor 211 passes through each of the slits 249.

The comb-tooth shape partition plate 237 is integrally welded to the side wall 205, and the comb-tooth shape partition plate 241 is integrally welded to the side wall 207. On the other hand, the comb-tooth shape partition plate 239 is integrally welded to a comb-tooth shape partition plate base 251.

In the above structure, first, unillustrated logs are fed into the log accommodating body 203. The rotor 209 and the rotor 211 are rotated inside the log accommodating body 203. With the function of the edges 223 of the debarking plates 221 of the rotating rotor 209, and with the abrading function of the edges 235 of the debarking plates 233 of the rotating rotor 211, and also with the abrasion of log to log contact, the bark of the fed logs is peeled.

The peeled bark drops downwardly from the rotor 209 and the rotor 211, via the slits 243 of the comb-tooth shape partition plate 237, the slits 245, 247 of the comb-tooth shape partition plate 239, and the slits 249 of the comb-tooth shape partition plate 241. The dropped bark is discharged out of the log accommodating body 203. On the other hand, the debarked logs are taken out to an outlet of the log accommodating body 203, and transferred to another place by an unillustrated conveyor.

The structure of this type of debarking machine is disclosed, for example, in Patent Document 1, Patent Document 2, Patent Document 3, etc. These Patent Documents were all filed by the applicant himself.

PRIOR ART DOCUMENTS

Patent Literature

[Patent Literature 1] U.S. Pat. No. 4,685,498
[Patent Literature 2] U.S. Pat. No. 5,630,453
[Patent Literature 3] U.S. Pat. No. 5,647,418

SUMMARY OF INVENTION

Technical Problems

The conventional structure as described above has the following problems:

As described above, the peeled bark drops downwardly from the rotor 209 and the rotor 211, via the slits 243 of the comb-tooth shape partition plate 237, the slits 245, 247 of the comb-tooth shape partition plate 239, and the slits 249 of the comb-tooth shape partition plate 241. At that time, the slits 243, 245, 247, 249 may suffer wear or unexpected damage. In such a case, the worn portions or damaged portions will be fixed by hardfacing or patching work.

However, the comb-tooth shape partition plate 237 is integrally welded to the side wall 205, the comb-tooth shape partition plate 241 is also integrally welded to the side wall 207, and further, the comb-tooth shape partition plate 239 is also integrally welded to the comb-tooth shape partition plate base 251, and therefore, each rebuilding as described above has to be performed inside the log accommodating body 203. This causes troublesome work, much labor and long working time. Moreover, during rebuilding, the debarking machine needs to be stopped, which also deteriorates the debarker operating rate.

And, since the comb-tooth shape partition plate 239 is disposed between the rotor 209 and the rotor 211, it is impossible to perform rebuilding from the outside of the log accommodating body 203. This structure eventually forces rebuilders to enter the inside of the log accommodating body 203 to perform difficult work.

To cope with these problems, for example, structures as illustrated in FIG. 11 and FIG. 12 have been disclosed. In these structures, the comb-tooth shape partition plate 239 is detachably mounted on the comb-tooth shape partition plate base 251 by bolts 253. The bolts 253 are screwed into the comb-tooth shape partition plate base 251 via washers 255.

A screwhead of the bolt 253 and the washer 255 is accommodated inside a recessed part 257.

When the rebuilding is performed, the bolts 253 are loosened in order to detach the comb-tooth shape partition plate 239 from a supporting structure, namely the comb-tooth shape partition plate base 251. The detached comb-tooth shape partition plate 239 is taken out of the log accommodating body 203, thus the rebuilding thereon is performed outside the log accommodating body 203.

However, according to the above structures, it is necessary to take the comb-tooth shape partition plate 239, which is a large-sized element made of one-piece material, out of the log accommodating body 203. Further, after finishing of rebuilding, it is necessary to take the comb-tooth shape partition plate 239, still the large-sized element made of one-piece material, into the log accommodating body 203 again. These take-out and take-in works are troublesome and problematic.

Moreover, there is also a problem of mechanical strength. As illustrated in FIG. 11, the comb-tooth shape partition plate base 251 is substantially in a U shape, and the bolts 253, 253 are screwed into the end face of the thick plate members, respectively. Normally, the space (x) between the thick plate members is not so much wide, and eventually, an overhanging length of the comb-tooth shape partition plate 239 becomes longer, which may cause a large bending moment to the comb-tooth during operation of the machine.

To cope with such a situation, as illustrated in FIG. 12, there is another structure, in which the space between the thick plate members of the comb-tooth shape partition plate base 251 has been widened as ($X+\alpha$). However, this structure also requires the widening of space between the rotor 209 and the rotor 211 as ($L+\alpha$), which may result in the large-sizing of the debarking machine and affect debarking ability.

To solve the problems as described above, it is an object of the present invention, to provide a debarking machine, having a plurality of rotors disposed in parallel, and a comb-tooth shape partition plate for blocking the mutual space between the rotors, in which rebuilding and replacement works of the comb-tooth shape partition plate are facilitated.

Solutions of Problems

To achieve a solution of the above problems, according to claim 1 of the present invention, a debarking machine comprises: a log accommodating body; a plurality of rotors rotatively mounted inside the log accommodating body and provided with debarking plates; a comb-tooth shape partition plate base disposed at a mutual space between the plurality of rotors; a comb-tooth shape partition plate detachably mounted on the comb-tooth shape partition plate base; and a fixer for fastening the comb-tooth shape partition plate to the comb-tooth shape partition plate base. The comb-tooth shape partition plate is composed of a plurality of partition plate elements divided along the axial directions the rotors, and each of the plurality of partition plate elements is detachable separately.

According to claim 2 of the present invention, with regard to the debarking machine as claimed in claim 1, the comb-tooth shape partition plate base is composed of a base main body and a comb-tooth shape backing plate mounted on the base main body. The comb-tooth shape partition plate is detachably mounted on the comb-tooth shape backing plate.

According to claim 3 of the present invention, with regard to the debarking machine as claimed in claim 2, the comb-tooth shape backing plate is smaller than the comb-tooth shape partition plate.

According to claim 4 of the present invention, with regard to the debarking machine as claimed in claim 2 or claim 3, the fixer is a plurality of bolts, and a partial number of the bolts is screwed into a tooth part of comb of the comb-tooth shape partition plate and into a tooth part of comb of the comb-tooth shape backing plate.

Further, according to claim 5 of the present invention, with regard to the debarking machine as claimed in any one claim of claim 1 to claim 4, the comb-tooth shape partition plate is provided with debarking enhancing blocks.

Effects of Invention

As discussed above, according to claim 1 of the present invention, a debarking machine comprises: a log accommodating body; a plurality of rotors rotatively mounted inside the log accommodating body and provided with debarking plates; a comb-tooth shape partition plate base disposed at a mutual space between the plurality of rotors; a comb-tooth shape partition plate detachably mounted on the comb-tooth shape partition plate base; and a fixer for fastening the comb-tooth shape partition plate to the comb-tooth shape partition plate base. The comb-tooth shape partition plate is composed of a plurality of partition plate elements divided along the axial directions the rotors, and each of the plurality of partition plate elements is detachable separately. Therefore, rebuilding and replacement works of the comb-tooth shape partition plate are facilitated.

Moreover, according to claim 2 of the present invention, with regard to the debarking machine as claimed in claim 1, the comb-tooth shape partition plate base is composed of a base main body and a comb-tooth shape backing plate mounted on the base main body. The comb-tooth shape partition plate is detachably mounted on the comb-tooth shape backing plate. Therefore, in addition to the above effect of invention, the comb-tooth shape partition plate is strongly supported by the comb-tooth shape backing plate.

Moreover, according to claim 3 of the present invention, with regard to the debarking machine as claimed in claim 2, the comb-tooth shape backing plate is smaller than the comb-tooth shape partition plate. Therefore, function of the comb-tooth shape partition plate is not deteriorated.

Moreover, according to claim 4 of the present invention, with regard to the debarking machine as claimed in claim 2 or claim 3, the fixer is a plurality of bolts, and a partial number of the bolts is screwed into a tooth part of comb of the comb-tooth shape partition plate and into a tooth part of comb of the comb-tooth shape backing plate. Therefore, with regard to dynamic load applied to the teeth of comb slits during debarking of logs, the dynamic moment can be reduced.

Further, according to claim 5 of the present invention, with regard to the debarking machine as claimed in any one claim of claim 1 to claim 4, the comb-tooth shape partition plate is provided with debarking enhancing blocks. Therefore, debarking performance may be improved.

DESCRIPTION OF EMBODIMENTS

Figure 1:
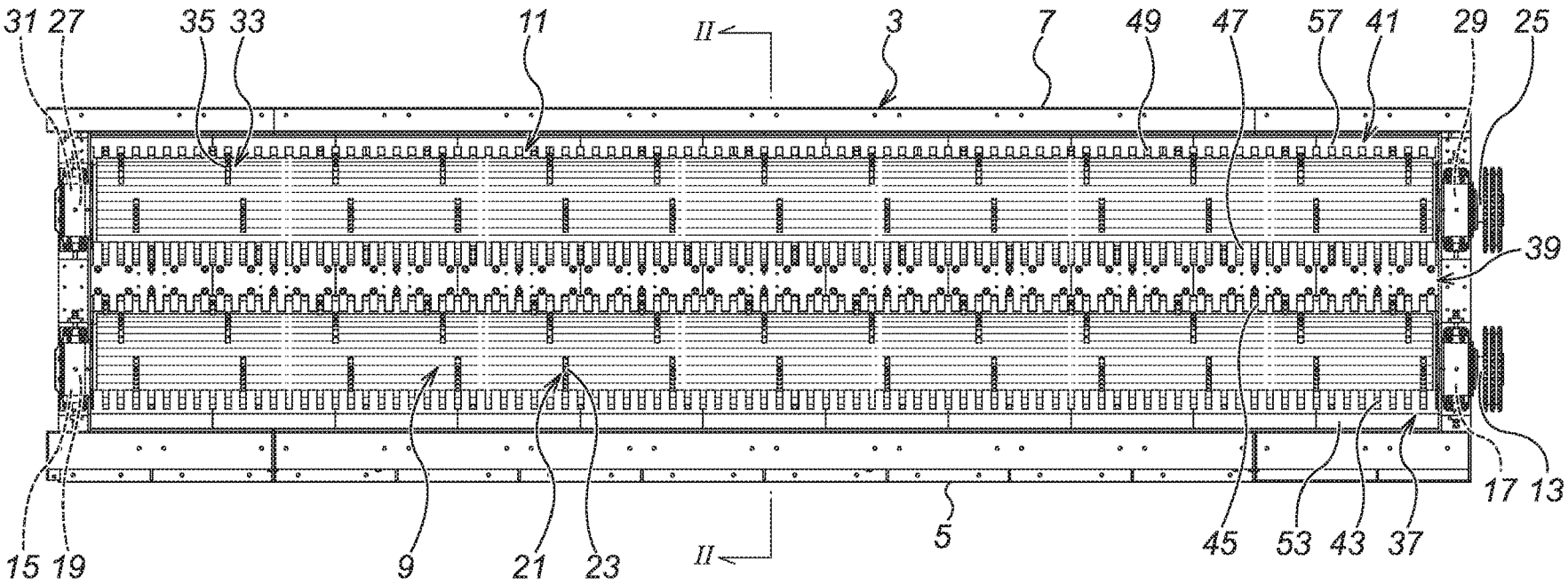
FIG. 1 is a plan view of a debarking machine according to a first embodiment of the present invention.

Now, a first embodiment of the present invention will be explained with reference to FIGS. 1 to 6. A concreate foundation 1 is provided, and a log accommodating body 3 is mounted on the concreate foundation 1. The log accommodating body 3 comprises a pair of side walls 5, 7, etc. Rotors 9, 11 are rotatively provided in parallel, respectively, inside the log accommodating body 3. The rotor 11 is disposed obliquely downward of the rotor 9.

The rotor 9 is in a cylindrical shape, and shafts 13, 15 are protrusively provided, respectively, at each end of the rotor 9. The rotor 9 is pivotally supported by bearings 17, 19, via the shafts 13, 15, respectively. A plurality of debarking plates 21 is mounted on the outer peripheral surface of the rotor 9, and at the top surface of each of the debarking plates 21, a plurality of edges 23 is provided. Each of the edges 23 has a function of peeling bark from the surface of logs.

The rotor 11 has substantially the same structure as that of the rotor 9, and shafts 25, 27 are protrusively provided, respectively, at each end of the rotor 11. The rotor 11 is pivotally supported by bearings 29, 31, via the shafts 25, 27, respectively. A plurality of debarking plates 33 is mounted on the outer peripheral surface of the rotor 11, and at the top surface of each of the debarking plates 33, a plurality of edges 35 is provided. Each of the edges 35 has a function of peeling bark from the surface of logs.

Figure 2:
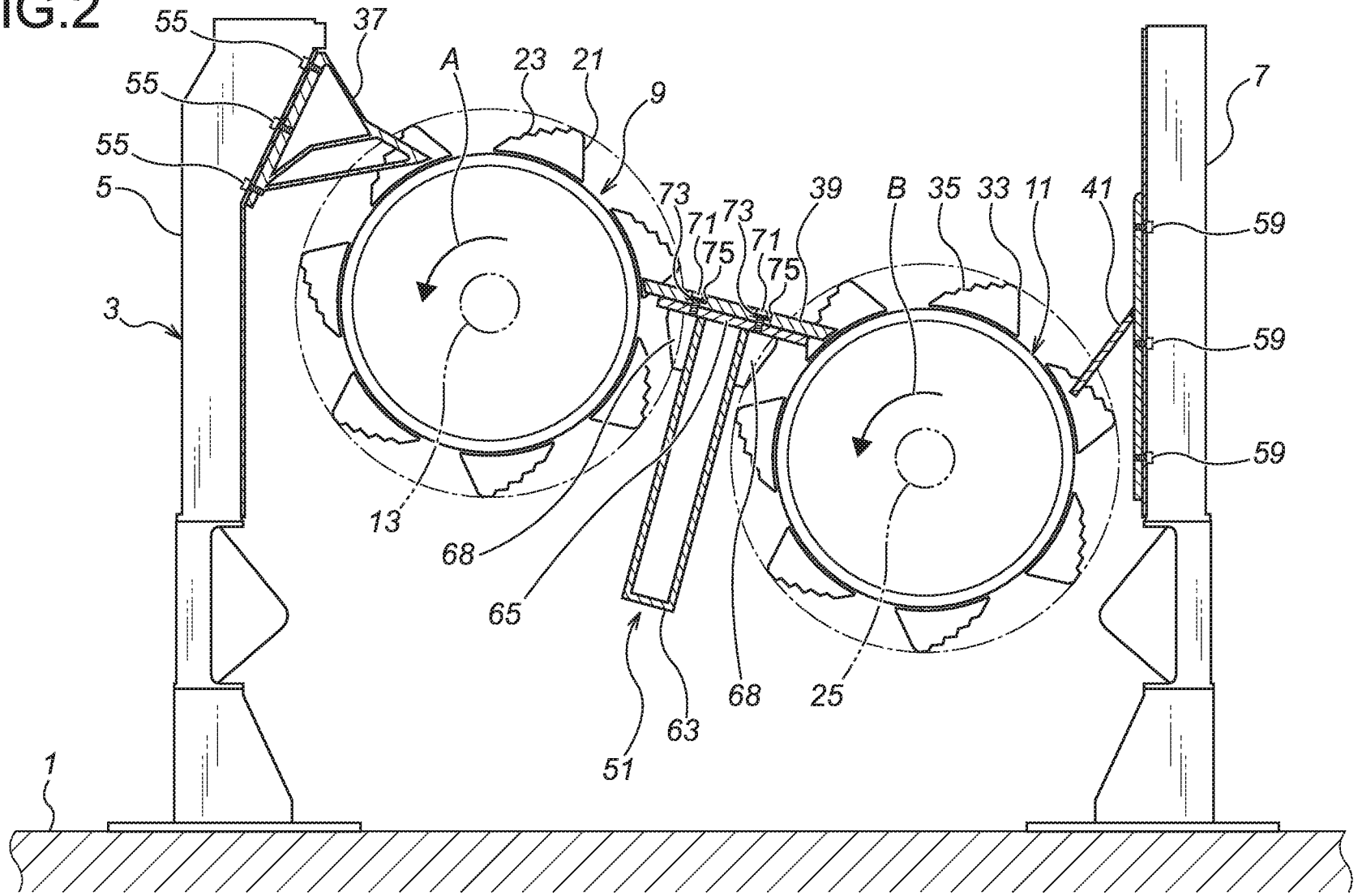
FIG. 2 is a sectional view as viewed from a line II-II of FIG. 1 according to the first embodiment of the present invention.
Figure 3:
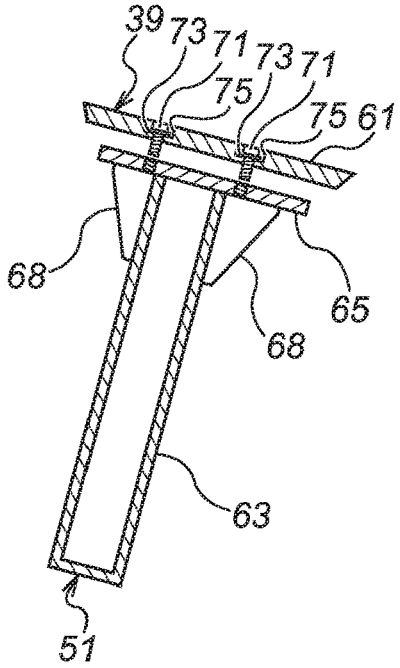
FIG. 3 is an exploded side view showing a structure of a comb-tooth shape partition plate base and a comb-tooth shape partition plate according to the first embodiment of the present invention.

The rotors 9, 11 are rotated by an unillustrated driving motor and rotation transmission mechanism, in the directions shown by arrows A and B of FIG. 2, respectively.

A comb-tooth shape partition plate 37 is disposed between the side wall 5 and the rotor 9. A comb-tooth shape partition plate 39 is disposed between the rotor 9 and the rotor 11. Moreover, a comb-tooth shape partition plate 41 is disposed between the rotor 11 and the side wall 7.

The comb-tooth shape partition plate 37 is provided with a plurality of slits 43 at predetermined spacings, on the side of the rotor 9, and each of the debarking plates 21 of the rotor 9 passes through each of the slits 43. Moreover, with regard to the comb-tooth shape partition plate 39, a plurality of slits 45 is provided at predetermined spacings on the side of the rotor 9, and a plurality of slits 47 is provided at predetermined spacings on the side of the rotor 11. Each of the debarking plates 21 of the rotor 9 passes through each of the slits 45, and each of the debarking plates 33 of the rotor 11 passes through each of the slits 47, respectively. Moreover, the comb-tooth shape partition plate 41 is provided with a plurality of slits 49 at predetermined spacings, on the side of the rotor 11, and each of the debarking plates 33 of the rotor 11 passes through each of the slits 49.

The comb-tooth shape partition plate 37 is fastened to the side wall 5, and the comb-tooth shape partition plate 41 is fastened to the side wall 7. On the other hand, the comb-tooth shape partition plate 39 is detachably fastened to a comb-tooth shape partition plate base 51.

The comb-tooth shape partition plate 37 is composed of a plurality of (in the present embodiment, nine) partition plate elements 53, respectively divided along the axial directions of the rotor 9 and the rotor 11. Each of the partition plate elements 53 is detachably fastened by bolts 55.

Similarly, the comb-tooth shape partition plate 41 is also composed of a plurality of (in the present embodiment, nine) partition plate elements 57, respectively divided along the axial directions of the rotor 9 and the rotor 11. Each of the partition plate elements 57 is detachably fastened by bolts 59.

Figure 4:
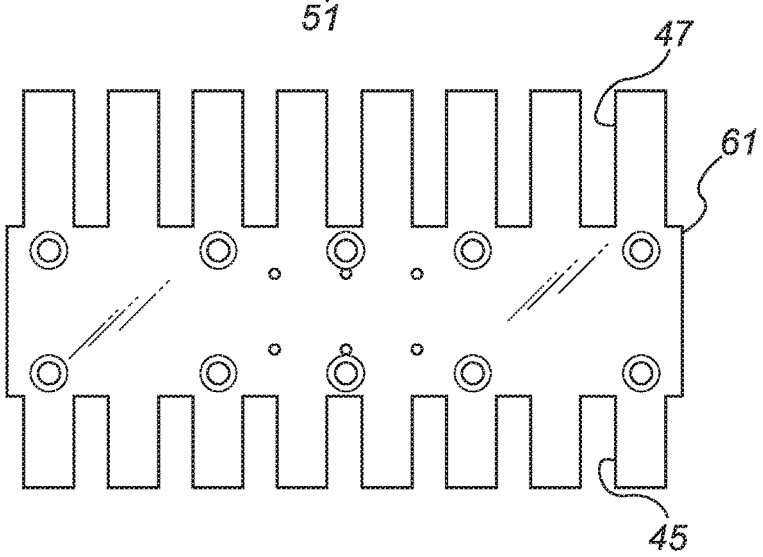
FIG. 4 is a plan view of a partition plate element of the comb-tooth shape partition plate according to the first embodiment of the present invention.

And similarly, the comb-tooth shape partition plate 39 is also composed of a plurality of (in the present embodiment, nine) partition plate elements 61, respectively divided along the axial directions of the rotor 9 and the rotor 11. FIG. 4 is a plan view of the partition plate element 61.

The comb-tooth shape partition plate base 51 is composed of a base main body 63 substantially in a U-shape, a comb-tooth shape backing plate 65 fastened to the upper end of the base main body 63, and a plurality of support ribs 68 attached between the base main body 63 and the comb-tooth shape backing plate 65.

Figure 5:
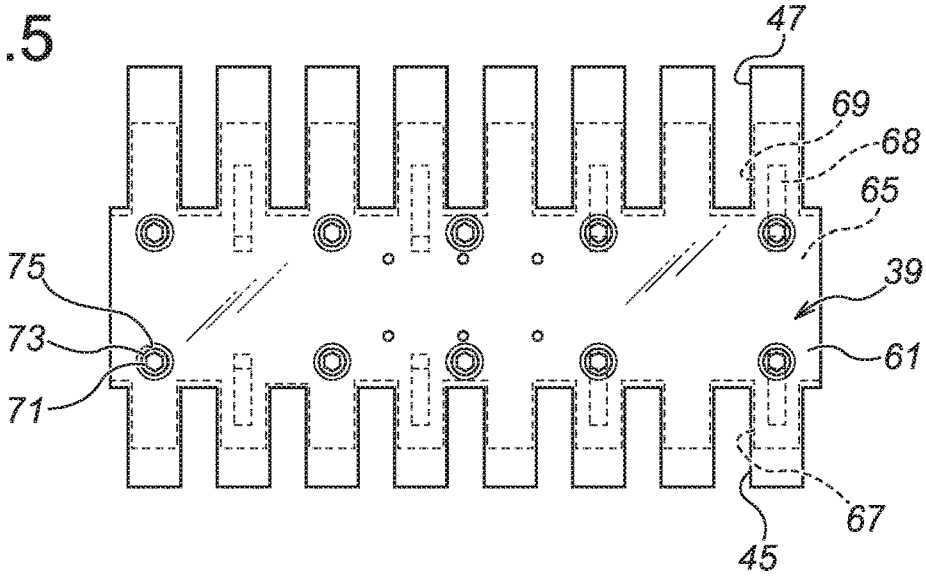
FIG. 5 is a plan view according to the first embodiment of the present invention, showing a state that the partition plate element of the comb-tooth shape partition plate is mounted on the comb-tooth shape backing plate.

As illustrated in FIG. 5, the comb-tooth shape backing plate 65 is provided with a plurality of slits 67 at predetermined spacings, on the side of the rotor 9, and with a plurality of slits 69 at predetermined spacings, on the side of the rotor 11. Each of the debarking plates 21 of the rotor 9 passes through each of the slits 67, and each of the debarking plates 33 of the rotor 11 passes through each of the slits 69, respectively. The spacings of the slits 67, 69 are the same, respectively, as the spacings of the slits 45, 47 of the comb-tooth shape partition plate 39, as described above. Moreover, the size of the comb-tooth shape backing plate 65 is smaller than the size of the comb-tooth shape partition plate 39.

Each of the partition plate elements 61 of the comb-tooth shape partition plate 39 is detachably fastened onto the comb-tooth shape backing plate 65 by a plurality of (in the present embodiment, ten) bolts 71. Each of the bolts 71 is screwed into the comb-tooth shape backing plate 65, respectively, via a washer 73, through a penetration hole formed in the partition plate element 61. A recessed part 75 is formed in the rim of the penetration hole, and a screwhead of the bolt 71 and the washer 73 are accommodated in the recessed part 75.

Now, function of the present embodiment will be described based on the above structure.

First, unillustrated logs are fed into the log accommodating body 3. The rotor 9 and the rotor 11 are rotated inside the log accommodating body 3. With the function of the edges 23 of the debarking plates 21 of the rotating rotor 9, and with the function of the edges 35 of the debarking plates 33 of the rotating rotor 11, and also with the abrasion of each of the logs, the bark of the fed logs is peeled.

The peeled bark drops downwardly from the rotor 9 and the rotor 11, via the slits 43 of the comb-tooth shape partition plate 37, the slits 45, 47 of the comb-tooth shape partition plate 39, and the slits 49 of the comb-tooth shape partition plate 41. The dropped bark is discharged. On the other hand, the debarked logs are taken out to an outlet of the log accommodating body 3, and transferred to another place by an unillustrated conveyor.

Next, the rebuilding and replacement works of the comb-tooth shape partition plate 39 will be explained.

For example, among the plurality of (in the present embodiment, nine) partition plate elements 61, the partition plate elements 61, for which the rebuilding is required, are partially detached. For that purpose, the ten-piece bolts 71 are loosened, and then, each of the partition plate elements 61 subject to be rebuilt is detached from the comb-tooth shape backing plate 65, and is taken out of the log accommodating body 3. Thereafter, the damaged or worn portions of each of the partition plate elements 61 are rebuilt by hardfacing or patching work. After finishing of the rebuilding, the rebuilt partition plate elements 61 are taken into the log accommodating body 3, and fastened to predetermined positions of the comb-tooth shape backing plate 65, respectively, by the ten-piece bolts 71 and the washers 73.

The replacement work of the partition plate element 61 is performed substantially in the same manner. The ten-piece bolts 71 are loosened, and then, the partition plate element 61 is detached from the comb-tooth shape backing plate 65, and is taken out of the log accommodating body 3. As a replacement, a new partition plate element 61 is taken into the log accommodating body 3, and fastened to a predetermined position of the comb-tooth shape backing plate 65, by the ten-piece bolts 71 and the washers 73.

The rebuilding and replacement works of the comb-tooth shape partition plate 37 and the comb-tooth shape partition plate 41 are also performed substantially in the same manner. With regard to the comb-tooth shape partition plate 37, each of the partition plate elements 53 is separately detached as required, and then, the rebuilding and replacement works are performed. With regard to the comb-tooth shape partition plate 41, each of the partition plate elements 57 is separately detached as required, and then, the rebuilding and replacement works are performed.

Figure 6A:
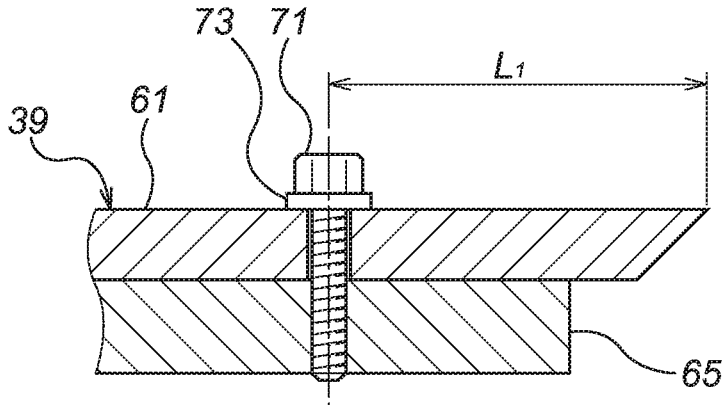
FIG. 6 are side views according to the first embodiment of the present invention, explaining the function and effect in comparison with those of the conventional structure, in which, FIG. 6 (*a*) is a side view according to the embodiment of the present invention, and FIG. 6 (*b*) is a side view according to a conventional art.
Figure 6B:
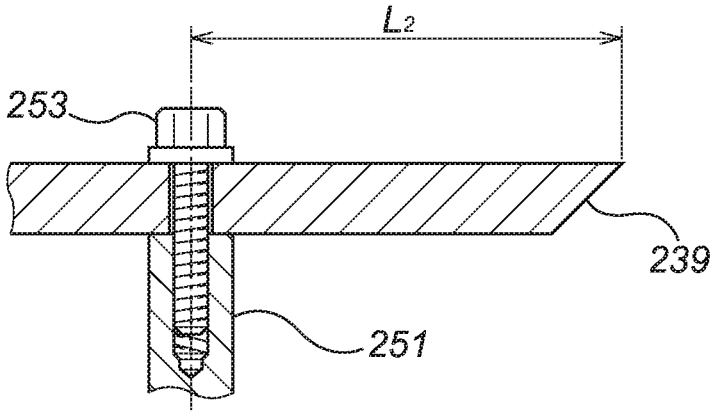

Next, the load applied to the bolt 71 will be explained. FIG. 6 illustrates the load applied to the bolt 71, in comparison with that of the conventional art. FIG. 6 (*a*) shows a state according to the present embodiment, and FIG. 6 (*b*) shows a state according to the conventional art. According to the present embodiment, as illustrated in FIG. 6 (*a*), the comb-tooth shape backing plate 65 is provided, and a screw-engagement position of the bolt 71 is disposed more outwardly than that of the conventional art. Thus, an overhanging length ($L_1$) is shorter than that of the conventional art. Accordingly, for example, where load is applied to the end of the comb-tooth shape partition plate 39, the moment applied to the bolt 71 is reduced.

On the other hand, according to the conventional art, an overhang length ($L_2$) is longer. Therefore, for example, where load is applied to the end of the comb-tooth shape partition plate 239, the moment load applied to the bolt 253 becomes larger.

The present embodiment as described above has the following effects:

First, the rebuilding and replacement works of the comb-tooth shape partition plate 39 is facilitated. This is because of the structure that the comb-tooth shape partition plate 39 is divided into a plurality of partition plate elements 61, so that each of the partition plate elements 61 can be detached separately. Thus, only the partition plate elements 61 subject to be rebuilt or replaced can be detached from the comb-tooth shape backing plate 65 so as to be taken out of the log accommodating body 3.

The effect of the comb-tooth shape partition plate 37 is substantially the same. The comb-tooth shape partition plate 37 is divided into a plurality of partition plate elements 53, so that each of the partition plate elements 53 can be detached separately. Thus, only the partition plate elements 53 subject to be rebuilt or replaced can be taken out of the log accommodating body 3.

Also, the effect of the comb-tooth shape partition plate 41 is substantially the same. The comb-tooth shape partition plate 41 is divided into a plurality of partition plate elements 57, so that each of the partition plate elements 57 can be detached separately. Thus, only the partition plate elements 57 subject to be rebuilt or replaced can be taken out of the log accommodating body 3.

Moreover, a bending moment applied to the comb-tooth shape partition plate 39 is reduced, whereby the stress loading thereof can be lessened. This is because of the structure that, with the disposition of the comb-tooth shape backing plate 65, the spacings of the fixing positions by the bolts 71 can be enlarged, whereby the overhanging length ($L_1$) can be shortened.

Moreover, since the overhanging length ($L_1$) is shortened, it is not necessary to widen the space between the rotor 9 and the rotor 11, and accordingly, the large-sizing of the debarking machine is not required.

Figure 7:
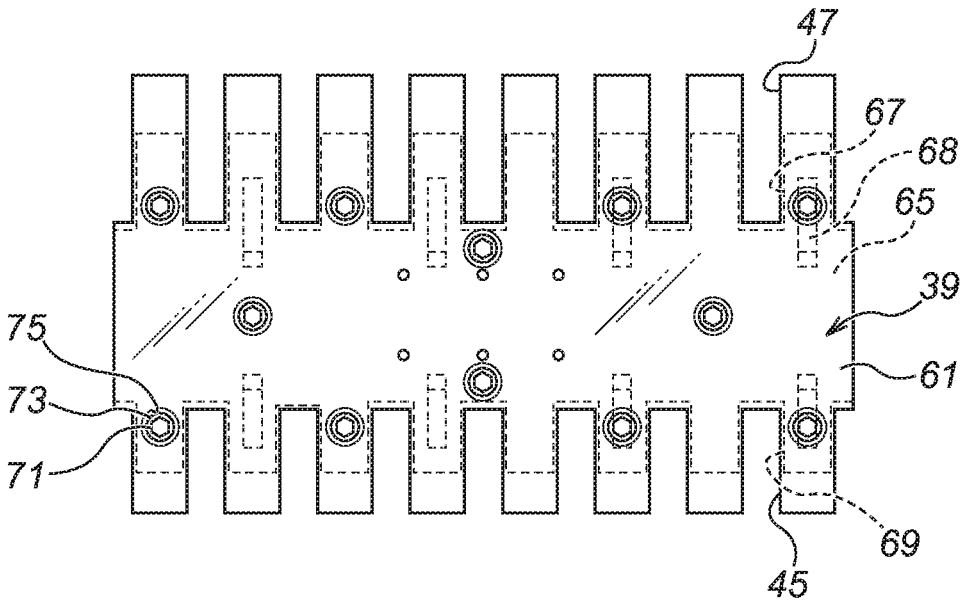
FIG. 7 is a plan view according to a second embodiment of the present invention, showing a state that a partition plate element of a comb-tooth shape partition plate is mounted on a comb-tooth shape backing plate.

Next, a second embodiment of the present invention will be explained with reference to FIG. 7. According to the first embodiment, all of the spacings of the bolts 71 in the width direction are equal to each other. However, according to the second embodiment, the spacings of respective two pairs of the bolts 71, 71 on the right and left sides of FIG. 7, are larger in the width direction. This structure is realized because the comb-tooth shape backing plate 65 is in the shape of comb-tooth.

The other structure is substantially the same as that of the first embodiment, so the same reference numerals are allotted to the same elements, and the detailed explanation thereof will not be made.

Accordingly, substantially the same effect as that of the first embodiment can be realized, and since the spacing of some of the bolts 71 are enlarged in the width direction, a more robust structure can be provided.

Figure 8:
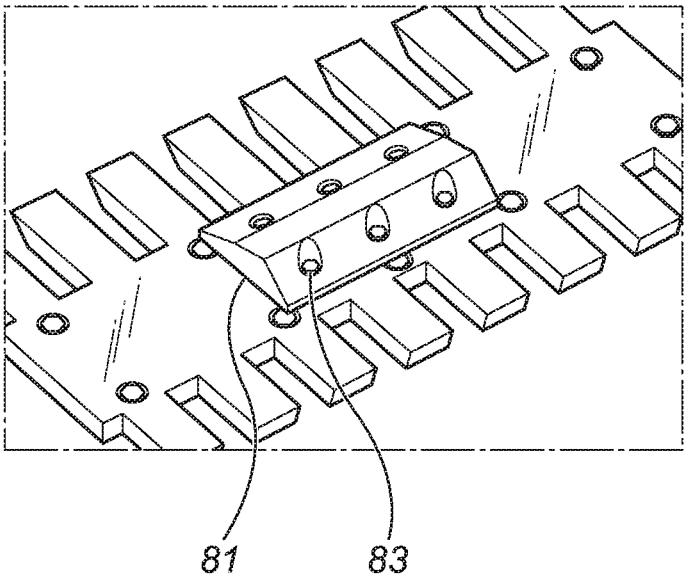
FIG. 8 is a perspective view according to a third embodiment of the present invention, showing a state that a debarking enhancing block is mounted on a comb-tooth shape partition plate.
Figure 9:
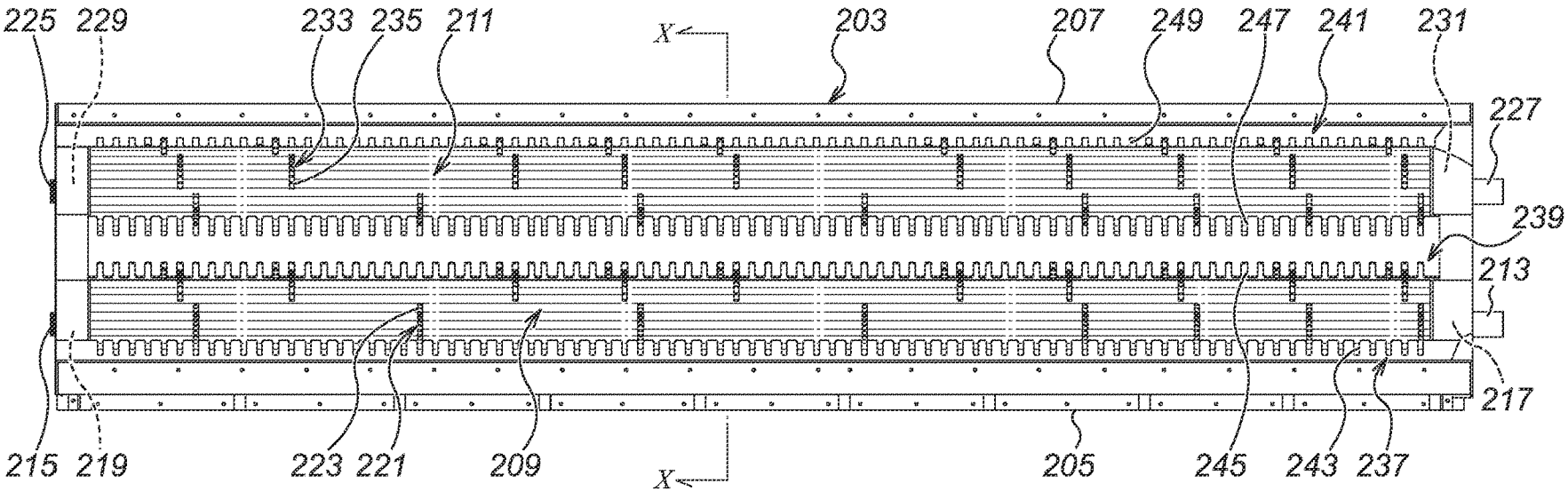
FIG.9 Prior Art
FIG. 9 is a plan view of a debarking machine according to a conventional art.
Figure 10:
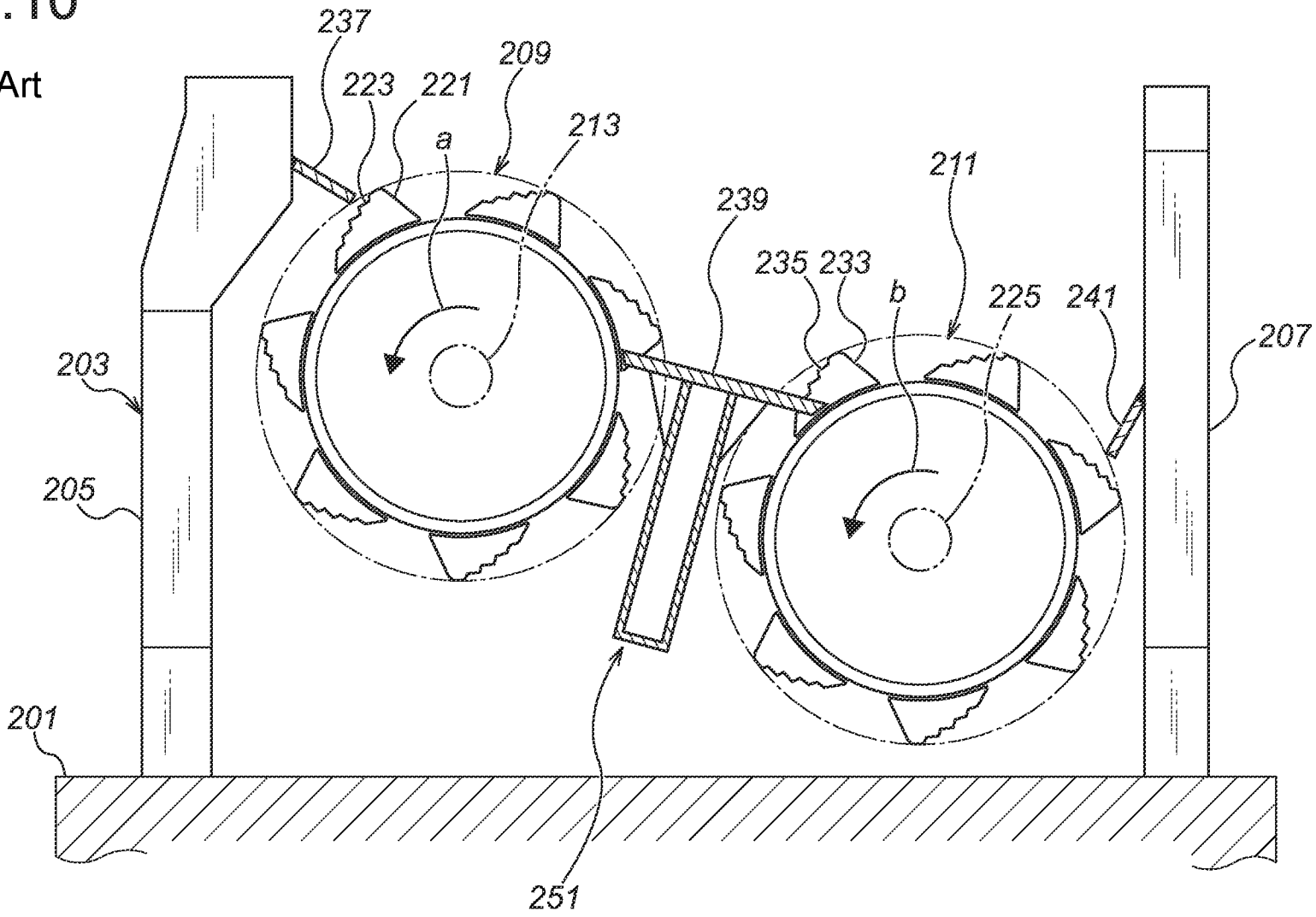
FIG.10 Prior Art
FIG. 10 is a sectional view of the conventional art, as viewed from a line X-X of FIG. 9.
Figure 11:
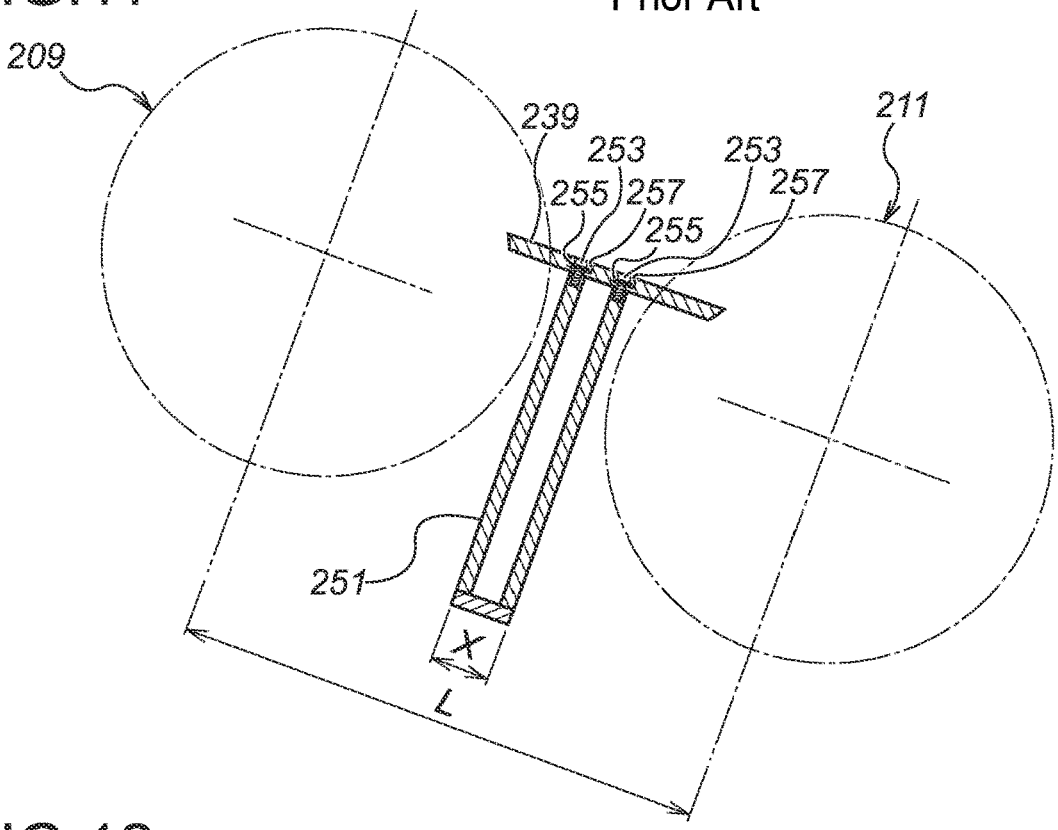
FIG.11 Prior Art
FIG. 11 is a sectional view of the conventional art showing a structure of a comb-tooth shape partition plate base and a comb-tooth shape partition plate.
Figure 12:
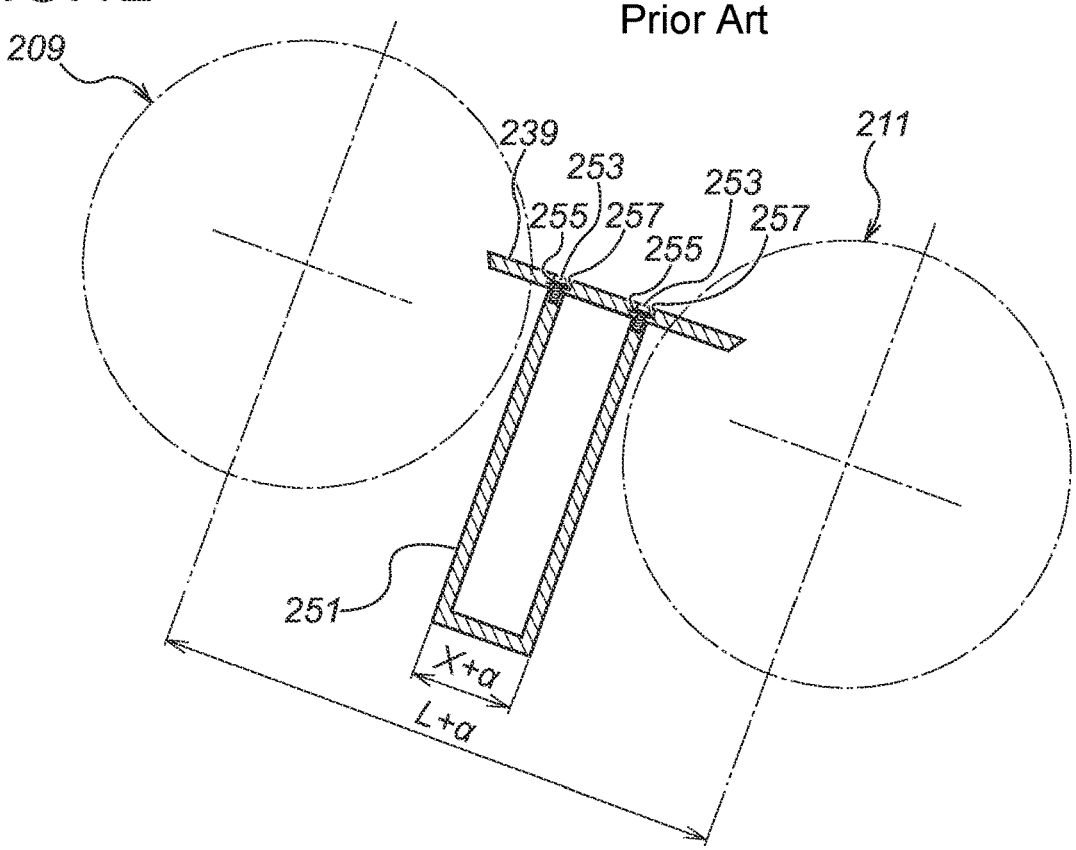
FIG.12 Prior Art
FIG. 12 is a sectional view of the conventional art showing a structure of the comb-tooth shape partition plate base and the comb-tooth shape partition plate.

Next, a third embodiment of the present invention will be explained with reference to FIG. 8. According to the third embodiment, a debarking enhancing block 81 is detachably mounted on the comb-tooth shape partition plate 39. The debarking enhancing block 81, of which cross-sectional shape is a low-profile isosceles triangle, is fastened by a plurality of (in the present embodiment, six) bolts 83. The other structure is substantially the same as that of the first embodiment, so the same reference numerals are allotted to the same elements, and the detailed explanation thereof will not be made.

According to the above structure, substantially the same effect as those of the first and second embodiments can be accomplished, and since the debarking enhancing blocks 81 are provided, the debarking function may be improved.

The present invention is not limited to the first through third embodiments.

For example, the first through third embodiments are explained in the case of two rotors. However, the rotors may be three or more.

Moreover, the first through third embodiments are explained in the case that the comb-tooth shape partition plate is divided into nine pieces along the axial direction of the rotor. However, the number of divided pieces may be determined arbitrarily.

Moreover, the first through third embodiments are explained in the case that the comb-tooth shape partition plate is fastened to the comb-tooth shape backing plate by bolts. However, for example, pins may be used for fastening.

The structures shown in the drawings are all for exemplification purposes only.

INDUSTRIAL APPLICABILITY

The present invention relates to a debarking machine, which for example peels bark from the surface of logs. More specifically, the present invention relates to a debarking machine, provided with a plurality of rotors disposed in parallel, and with a comb-tooth shape partition plate for blocking the mutual space between the rotors, in which rebuilding and replacement works of the comb-tooth shape partition plate are facilitated. The present invention is suitable, for example, for debarking machines used in wood chip plants.

EXPLANATION OF REFERENCE NUMERALS

3 log accommodating body
9 rotor
11 rotor
21 debarking plate
23 edge
33 debarking plate
35 edge
37 comb-tooth shape partition plate
39 comb-tooth shape partition plate
41 comb-tooth shape partition plate
51 comb-tooth shape partition plate base
53 partition plate element
55 bolt
57 partition plate element
59 bolt
61 partition plate element
63 base main body
65 comb-tooth shape backing plate
67 support panel
71 fixer
73 washer
81 debarking enhancing block

The invention claimed is:

1. A debarking machine, comprising:
a log accommodating body;
a plurality of rotors rotatively mounted inside the log accommodating body and provided with debarking plates;
a comb-tooth shape partition plate base disposed at a mutual space between the plurality of rotors;
a comb-tooth shape partition plate detachably mounted on the comb-tooth shape partition plate base; and
a fixer for fastening the comb-tooth shape partition plate to the comb-tooth shape partition plate base, wherein,
the comb-tooth shape partition plate is composed of a plurality of partition plate elements divided along axial directions of the plurality of rotors, and each of the plurality of partition plate elements is detachable separately,
the comb-tooth shape partition plate base is composed of a base main body and a comb-tooth shape backing plate mounted on the base main body, and
the comb-tooth shape partition plate is detachably mounted on the comb-tooth shape backing plate.

2. The debarking machine as claimed in claim 1, wherein,
the comb-tooth shape backing plate is smaller than the comb-tooth shape partition plate.

3. The debarking machine as claimed in claim 1, wherein,
the fixer is a plurality of bolts, and a partial number of the bolts is screwed into a tooth part of comb of the comb-tooth shape partition plate and into a tooth part of comb of the comb-tooth shape backing plate.

4. The debarking machine as claimed in claim 1, wherein,
the comb-tooth shape partition plate is provided with debarking assist blocks.

5. The debarking machine as claimed in claim 2, wherein,
the fixer is a plurality of bolts, and a partial number of the bolts is screwed into a tooth part of comb of the comb-tooth shape partition plate and into a tooth part of comb of the comb-tooth shape backing plate.

6. The debarking machine as claimed in claim 2, wherein,
the comb-tooth shape partition plate is provided with debarking assist blocks.

7. The debarking machine as claimed in claim 3, wherein,
the comb-tooth shape partition plate is provided with debarking assist blocks.

* * * * *